US007500628B2

(12) United States Patent
Berger et al.

(10) Patent No.: US 7,500,628 B2
(45) Date of Patent: Mar. 10, 2009

(54) FOOD WASTE REDUCTION MECHANISM FOR DISPOSER

(75) Inventors: Thomas R. Berger, Racine, WI (US); Cynthia C. Jara-Almonte, Racine, WI (US); Joseph G. Farmerie, Muskego, WI (US)

(73) Assignee: Emerson Electric Co., St. Louis, MO (US)

( * ) Notice: Subject to any disclaimer, the term of this patent is extended or adjusted under 35 U.S.C. 154(b) by 228 days.

(21) Appl. No.: 11/725,239

(22) Filed: Mar. 16, 2007

(65) Prior Publication Data

US 2007/0181719 A1 Aug. 9, 2007

Related U.S. Application Data

(63) Continuation of application No. 10/790,311, filed on Mar. 1, 2004, now abandoned.

(60) Provisional application No. 60/453,067, filed on Mar. 7, 2003.

(51) Int. Cl.
*B02C 23/36* (2006.01)

(52) U.S. Cl. ..... 241/46.013; 241/88.1; 241/95

(58) Field of Classification Search ..... 241/46.013, 241/95, 88.1, 89.4
See application file for complete search history.

(56) References Cited

U.S. PATENT DOCUMENTS

| | | | |
|---|---|---|---|
| 1,174,656 | A | 3/1916 | Beckwith |
| 1,459,713 | A | 6/1923 | Beggs |
| 1,965,033 | A | 7/1934 | Dillion |
| 2,004,737 | A | 6/1935 | Tonks |
| 2,012,680 | A | 8/1935 | Hammes |
| 2,044,563 | A | 6/1936 | Carter |
| 2,044,564 | A | 6/1936 | Carter |

(Continued)

FOREIGN PATENT DOCUMENTS

| | | |
|---|---|---|
| GB | 604516 | 7/1948 |

(Continued)

OTHER PUBLICATIONS

2 Photographs of Grinding Plate by In-Sink-Erator available from about 1960 (Top View and Bottom View), 2-pages.

(Continued)

*Primary Examiner*—Bena Miller
(74) *Attorney, Agent, or Firm*—Harness, Dickey & Pierce, P.L.C.

(57) ABSTRACT

Various mechanisms for reducing food waste in a food waste disposer are disclosed. In each of the reduction mechanisms, structures are provided for shearing food waste as it passes through or past a rotating shredder plate of the disposer. In one embodiment, the reduction mechanism has a rotatable plate coupled to a rotational source and positioned for rotation relative to an inner wall of a stationary ring. The plate has a fixed lug attached to the rotatable plate and has a movable lug attached to the rotatable plate. In another embodiment, the reduction mechanism includes a rotatable plate coupled to a rotational source and a stationary plate disposed adjacent the rotatable plate. The stationary plate or impeller defines a plurality of apertures therethrough. At least one first portion of the rotatable plate or impeller shears over at least some of the apertures in the stationary plate to shear the food waste.

17 Claims, 11 Drawing Sheets

U.S. PATENT DOCUMENTS

| | | | | | |
|---|---|---|---|---|---|
| 2,225,171 | A | | 12/1940 | Hammes | |
| 2,782,997 | A | | 2/1957 | Wolff | |
| 2,952,288 | A | * | 9/1960 | Schnell | 241/56 |
| 2,953,179 | A | * | 9/1960 | Friess | 241/89.4 |
| 2,963,231 | A | | 12/1960 | Ewing | |
| 3,025,117 | A | | 3/1962 | Weiczorek | |
| 3,044,514 | A | * | 7/1962 | Schnell | 241/56 |
| 3,112,079 | A | | 11/1963 | Niekamp | |
| 3,113,735 | A | | 12/1963 | Clements | |
| 3,155,326 | A | | 11/1964 | Rhodes | |
| 3,211,389 | A | | 10/1965 | Sherman, Jr. | |
| 3,439,878 | A | | 4/1969 | Reaux | |
| 3,523,649 | A | * | 8/1970 | Laakso | 241/85 |
| 3,581,790 | A | * | 6/1971 | Conte | 241/88.1 |
| 3,581,791 | A | * | 6/1971 | Otto | 241/89.4 |
| 3,589,624 | A | | 6/1971 | Smith | |
| 3,738,596 | A | * | 6/1973 | Miles | 241/95 |
| 3,804,341 | A | | 4/1974 | Guth | |
| 3,862,720 | A | | 1/1975 | Guth | |
| 3,875,462 | A | | 4/1975 | Keifer et al. | |
| 4,128,210 | A | | 12/1978 | Brenner et al. | |
| 4,134,555 | A | | 1/1979 | Rosselet | |
| 4,573,642 | A | | 3/1986 | Spelber | |
| 4,776,523 | A | | 10/1988 | Hurst | |
| 4,917,311 | A | | 4/1990 | Yoshino et al. | |
| 5,129,590 | A | | 7/1992 | Shinya | |
| 5,340,036 | A | | 8/1994 | Riley | |
| 5,533,681 | A | | 7/1996 | Riley | |
| 5,731,199 | A | * | 3/1998 | Roggero | 435/306.1 |
| 6,007,006 | A | | 12/1999 | Engel et al. | |
| D436,496 | S | | 1/2001 | Anderson et al. | |
| 6,439,487 | B1 | | 8/2002 | Anderson et al. | |
| 6,481,652 | B2 | | 11/2002 | Strutz et al. | |
| 6,655,615 | B1 | * | 12/2003 | Hartmann | 241/89.3 |

FOREIGN PATENT DOCUMENTS

| | | |
|---|---|---|
| GB | 790630 | 2/1958 |

OTHER PUBLICATIONS

2 Photographs of Grinding Plate by In-Sink-Erator available form about 1968 (Top Viw and Bottom View), 2-pages.

2 Photographs of Grinding Plate by In-Sink-Erator available from about 1970 (Top View and Bottom View), 2-pages.

International Search Report for corresponding International Patent Application No. PCT/US2004/006416.

* cited by examiner

FOOD WASTE REDUCTION MECHANISM FOR DISPOSER

CROSS-REFERENCE TO RELATED APPLICATIONS

This application is a continuation of U.S. patent application Ser. No. 10/790,311 filed on Mar. 1, 2004. U.S. Ser. No. 10/790,311 claims the benefit of Provisional Application No. 60/453,067, filed Mar. 7, 2003. The disclosures of the above applications are incorporated herein by reference.

FIELD

The present invention relates generally to a food waste disposer and more particularly to a mechanism for reducing food waste in a disposer.

BACKGROUND

In designing a mechanism for reducing food waste in a food waste disposer, consideration must be paid to the speed with which a reduction operation is completed and the resulting size of particulate matter produced during the reduction operation. A manufacturer must also consider the demands that a wide variety of food waste with varying properties (i.e., soft, hard, fibrous, stringy, leafy, elastic, and resilient) may have on a reduction mechanism in the disposer. Due to healthier diets, for example, consumers tend to eat more fruits and vegetables, resulting in food waste having a soft, stringy, leafy, or resilient consistency. Additionally, the modern diet has increased in consumption of white meat. The waste from meat typically includes bone. Although the bones from white meat are typically not as durable or difficult to grind compared to bones from red meat, the bones from white meat tend to splinter. In addition, the waste from white meat typically includes skin, which is elastic and resilient.

A number of mechanisms for reducing food waste in a food waste disposer are used in the art. One example of a mechanism of the prior art is used in the General Electric Model GFC 700Y Household Disposer manufactured by Watertown Industries. Other examples of mechanisms of the prior art are disclosed in U.S. Pat. No. 6,007,006 to Engel et al. and U.S. Pat. No. 6,439,487 to Anderson et al., which are owned by the assignee of record and are incorporated herein by reference in their entireties. In the prior art disposers of the '006 and '487 patents, a rotatable plate is connected to a motor and has lugs attached to the plate. A stationary ring is attached to the housing of the disposer and is positioned vertically about the periphery of the rotatable plate. During operation of the prior art mechanisms, food waste is delivered to the rotatable plate, and the lugs force the food waste against the stationary ring. Teeth on the stationary ring grind the food waste into particulate matter sufficiently small enough to pass from above the rotatable plate to below the plate via spaces between the teeth and the periphery of the rotatable plate. The particulate matter then passes to a discharge outlet of the disposer.

While mechanisms of the prior art disposer are satisfactory for reducing food waste in most applications, designers of food waste disposers continually strive to design and manufacture mechanisms capable of adequately reducing a number of types of food waste that may be encountered by the disposer. Current designs of reduction mechanisms in disposers may encounter some difficulty in sufficiently reducing fibrous, stringy, or elastic food waste, such as cornhusks, artichokes, parsley stems, poultry bones, and poultry skin, for example. Such food waste may pass though the radial spaces between the rotatable plate and stationary ring without being adequately reduced in size. Consequently, the passed fibrous or stringy food waste may create blockages in the disposer discharge or in the household plumbing.

The present invention is directed to overcoming, or at least reducing the effects of, one or more of the problems set forth above.

SUMMARY OF THE PRESENT DISCLOSURE

Various mechanisms for reducing food waste in a food waste disposer are disclosed. In each of the reduction mechanisms, structures are provided for shearing food waste as it passes through or past a rotating shredder plate of the disposer.

In one embodiment of the disclosed reductiori mechanism, a rotatable plate is coupled to a shaft of a motor housed in the disposer. A stationary plate is disposed adjacent the rotatable plate and defines a plurality of apertures therethrough. The stationary plate has a central opening. The rotatable plate is positioned for rotation within the central opening of the stationary plate. The rotatable plate has a central portion coupled to the motor shaft and has a peripheral portion disposed adjacent the central opening in the stationary plate. One or more lugs are attached to the peripheral portion of the rotatable plate and have a surface or edge for passing over the apertures in the stationary plate for shearing the food waste during operation. The lugs can be movably attached to the rotatable plate and capable of swiveling and sliding relative to the rotatable plate. Alternatively, the lugs can be fixedly attached to the rotatable plate. Moreover, a combination of fixed and movable lugs can be used on the rotatable plate. Interaction between the lugs and the apertures in the plate produce shearing or cutting forces for reducing the food waste. A stationary ring is disposed in the disposer and has an inner wall disposed about the stationary plate. The lugs attached to the rotatable plate can have ends for passing adjacent the inner wall. Interaction between the lugs and the stationary ring produce grinding or shredding forces for reducing the food waste.

In another embodiment of the disclosed reduction mechanism, an impeller has a central portion coupled to a motor shaft and has a wing portion positioned adjacent a stationary plate. A lug is attached to the wing portion and has a surface or edge for passing over the apertures in the stationary plate. The lug can be movably or fixedly attached to the impeller and can slide over to the stationary plate. Interaction between the lug and the apertures in the plate produce shearing or cutting forces for reducing the food waste. A substantially straight portion of the wing portion can also pass over the apertures in the stationary plate for shearing the food waste. Interaction between an end of the lug and the stationary ring produce grinding or shredding forces for reducing the food waste.

In another embodiment of the disclosed reduction mechanism, a stationary ring is disposed in a housing of the disposer between the inlet and the outlet of the disposer. A rotatable plate is coupled to a motor shaft and is positioned for rotation relative to the inner wall of the stationary ring. The plate has fixed and/or movable lugs for reducing food waste with the stationary ring. Interaction between ends of the lug and the stationary ring produce grinding or shredding forces for reducing the food waste. The rotatable plate has an edge forming a gap with the stationary ring for conveying reduced food waste to the outlet. One or more cutting elements are mounted in housing of the disposer adjacent a bottom surface of the plate. Blades of the cutting elements extend adjacent the gap for cutting food waste conveyed through the gap.

In another embodiment of the disclosed reduction mechanism, a stationary ring is disposed in a housing of the disposer between the inlet and the outlet of the disposer. A rotatable plate is coupled to a motor shaft and is positioned for rotation relative to the inner wall of the stationary ring. The plate has fixed and/or movable lugs for reducing food waste with the stationary ring. Interaction between ends of the lug and the stationary ring produce grinding or shredding forces for reducing the food waste. The rotatable plate has an edge forming a gap with the stationary ring for conveying reduced food waste to the outlet. One or more cutting elements are mounted on a bottom surface of the rotatable plate. Blades of the cutting elements extend beyond the edge of the plate for reducing food waste conveyed through the gap.

In another embodiment of the disclosed reduction mechanism, a stationary ring is disposed in a housing of the disposer between the inlet and the outlet of the disposer. A rotatable plate is coupled to a first shaft of a first motor and is positioned for rotation relative to the inner wall of the stationary ring. The plate has fixed and/or movable lugs for reducing food waste with the stationary ring. Interaction between ends of the lug and the stationary ring produce grinding or shredding forces for reducing the food waste. The rotatable plate has an edge forming a gap with the stationary ring for conveying reduced food waste to the outlet. A rotatable cutting member is disposed underneath the rotatable plate and is coupled to a hollow shaft of a second motor housed in the disposer. The hollow shaft is disposed over first shaft, and the motors are housed one above the other in the housing. The shafts rotate in opposite directions. Blades on the rotatable cutting member extend beyond the edge of the rotatable plate for reducing food waste conveyed through the gap between the rotatable plate and stationary ring.

In another embodiment of the disclosed reduction mechanism, a stationary ring is disposed in a housing of the disposer between the inlet and the outlet of the disposer. A rotatable plate is coupled to a motor shaft and is positioned for rotation relative to the inner wall of the stationary ring. The plate has fixed and movable lugs for reducing food waste with the stationary ring. Interaction between ends of the lugs and the stationary ring produce grinding or shredding forces for reducing the food waste. The rotatable plate has an edge forming a gap with the stationary ring for conveying reduced food waste to the outlet. A rotatable impact member is attached to a top surface of the rotatable plate. A plurality of hooked teeth on the rotatable impact member pass by the inner wall of the stationary ring. The hooked teeth also pass by breakers fixedly attached to the rotatable plate. The rotatable impact member-can have pitched surfaces for engaging water flow that causes the rotatable impact member to rotate. A drive belt can be disposed about a shaft of the rotatable impact member and disposed about a central hub in the disposer to cause the rotatable impact member to rotate.

In another embodiment of the disclosed reduction mechanism, a stationary ring is disposed in the housing of a disposer and has an inner wall. A rotatable plate is coupled to a motor shaft and is positioned for rotation relative to the inner wall of the stationary ring. One or more fixed lugs are attached to the rotatable plate for grinding food waste in combination with the inner wall of the stationary ring, and one or more movable lugs are attached to the rotatable plate for grinding food waste in combination with the inner wall of the stationary ring.

In another embodiment of the disclosed reduction mechanism, a rotatable plate is coupled to the shaft of the rotational source and is positioned for rotation in the housing. A first hub is mounted about the shaft. A second hub is rotatably mounted on the rotatable plate and has at least one cutting element attached thereto for reducing food waste. A drive member connects the first hub to the second hub for rotating the second hub during operation of the disposer.

The foregoing summary is not intended to summarize each potential embodiment or every aspect of the inventive concepts disclosed herein.

BRIEF DESCRIPTION OF THE DRAWINGS

The foregoing summary, preferred embodiments, and other aspects of the inventive concepts will be best understood with reference to a detailed description of specific embodiments, which follows, when read in conjunction with the accompanying drawings, in which.

Figure 1A:
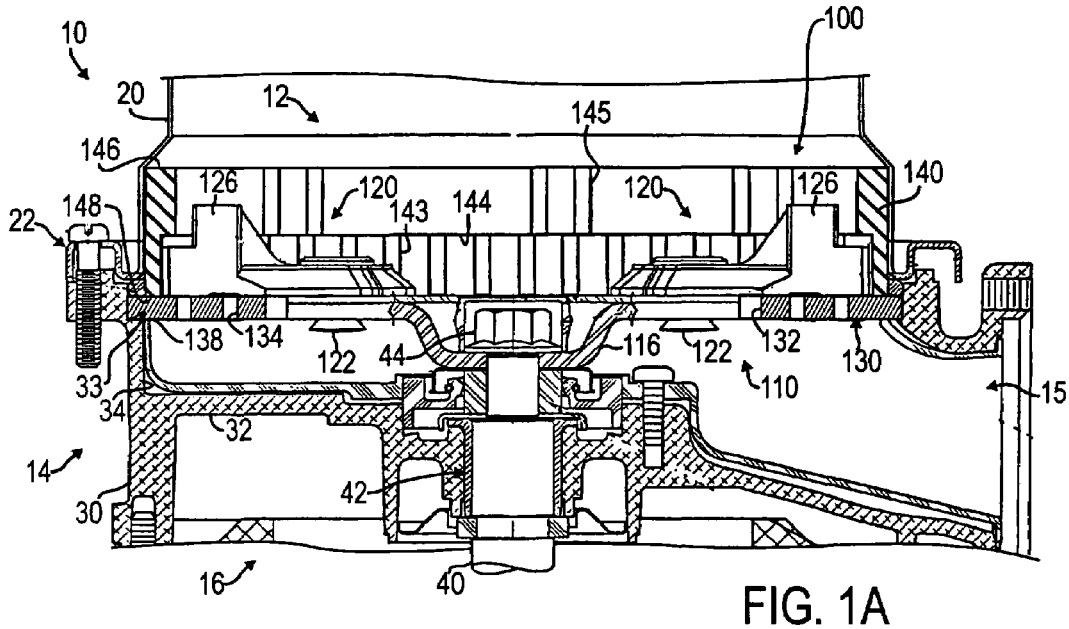
FIGS. 1A-1B illustrate various views of an embodiment of a reduction mechanism for shearing and grinding food waste according to certain teachings of the present disclosure, the disclosed reduction mechanism having a stationary ring, stationary plate, rotating plate, and movable lugs.

While the disclosed reduction mechanisms for a food waste disposer are susceptible to various modifications and alternative forms, specific embodiments thereof have been shown by way of example in the drawings and are herein described in detail. The figures and written description are not intended to limit the scope of the disclosed reduction mechanism in any manner. Rather, the figures and written description are provided to illustrate the disclosed reduction mechanism to a person skilled in the art by reference to particular embodiments of the invention, as required by 35 U.S.C. § 112.

DETAILED DESCRIPTION

In the interest of clarity, not all features of actual implementations of a reduction mechanism for a food waste disposer are described in the disclosure that follows. It will of course be appreciated that in the development of any such actual implementation, as in any such project, numerous engineering and design decisions must be made to achieve the developers' specific goals, e.g., compliance with mechanical and business related constraints, which will vary from one implementation to another. While attention must necessarily be paid to proper engineering and design practices for the environment in question, it should be appreciated that the development of a reduction mechanism would nevertheless be a routine undertaking for those of skill in the art given the details provided by this disclosure.

Figure 1B:
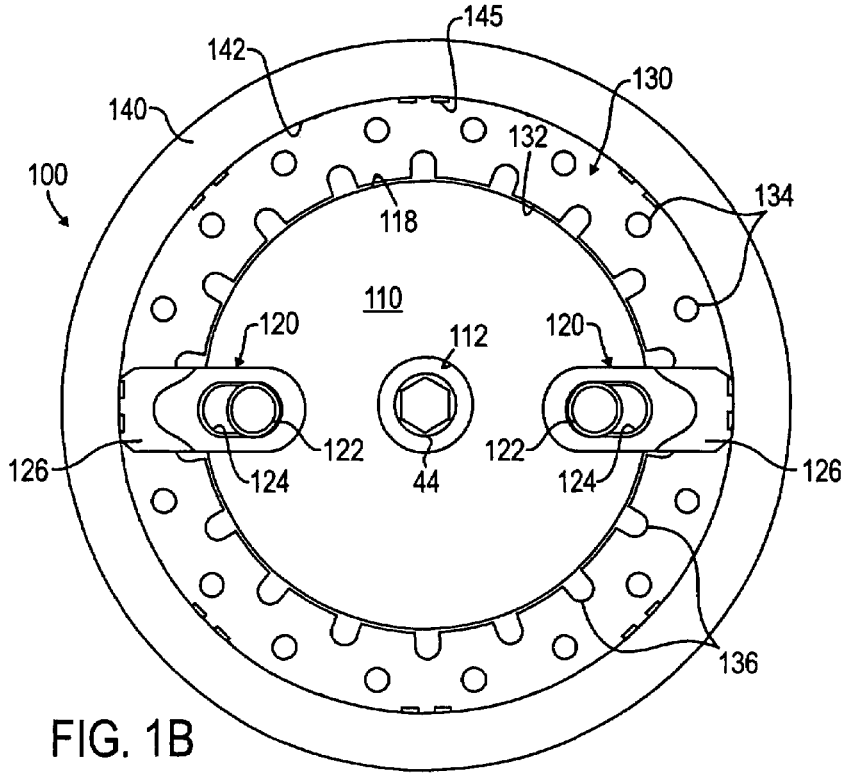

Referring to FIGS. 1A-1B, an embodiment of a reduction mechanism 100 is illustrated. FIG. 1A shows a portion of a food waste disposer 10 in side cross-section having the reduction mechanism 100, and FIG. 1B shows the reduction mechanism 100 in a top view. In FIG. 1A, the food waste disposer 10 has a food conveying section 12, a grinding section 14, and a motor section 16. In the present example, the food conveying section 12 and part of the grinding section 14 are formed with a first housing portion 20, while another part of the grinding section and the motor section 16 are formed with a second housing 30. Several techniques and methods exist in the art for constructing the housing of a food waste disposer, and the disclosed reduction mechanism 100 is not limited to only the construction illustrated herein. Other techniques and methods for constructing the housings of food waste disposers are disclosed in incorporated U.S. Pat. Nos. 6,007,006 and 6,439,487. The housing portions 20 and 30 are attached together by techniques known in the art. For example, a coupling 22 between the first and second housings 20 and 30 includes flanges connected with fasteners and sealant, such as disclosed in the incorporated U.S. Pat. Nos. 6,007,006 and 6,439,487.

The food conveying section 12 receives food waste (not shown) from a sink (not shown) and conveys the food waste to the grinding section 14. The disclosed reduction mechanism 100 is positioned in the grinding section 14 and includes a rotatable member or plate 110, one or more impact members or lugs 120, a first stationary member or plate 130, and a second stationary member or ring 140. A shaft 40 of a motor (not shown) passes through an upper end bell 32 of the housing 30 and connects to the rotatable plate 110. A bearing/seal mechanism 42 and a mounting fastener 44 are used at the connection of the rotatable plate 110 and the shaft 40. Teachings of a bearing/seal mechanism, a mounting fastener, and associated techniques are disclosed in the U.S. Pat. Nos. 6,007,006 and 6,439,487 patents.

The one or more impact members or lugs 120 are attached to the plate 110. Preferably, two lugs 120 are used. The lugs 120 are attached to a peripheral portion of the rotatable plate 110. In the present embodiment, the lugs 120 are movably attached to the rotatable plate 110. Fastening posts 122 have one end attached in holes (not shown) in the rotatable plate 110. Other ends of the fastening posts 122 are attached in elongated throughholes in the lugs 120 that allow the lugs 120 to swivel and to slide relative to the rotatable plate 110. The lugs 120 have weighted ends 126 on an opposite end of the lugs from the elongated throughholes 124.

The stationary plate 130 is disposed adjacent the rotatable plate 110. As best shown in FIG. 1A, the stationary plate 130 extends beyond an inner dimension of the stationary ring 140 so that an outside edge 138 of the stationary plate 130 is mounted adjacent the ring 140. In the present embodiment, the edge 138 of the stationary plate 130 and a bottom shoulder 148 of the ring 140 are held together by a compression fit formed by the coupling 22 between the outside housings 20 and 30. In alternative embodiments, fasteners, clamps, welding, or other techniques and methods known in the art can be used to fixedly mount the stationary plate 130 and ring 140 adjacent one another. The stationary plate 130 defines a central opening 132 in which the rotatable plate 110 is positioned. The stationary plate 130 and the rotatable plate 110 are preferably on substantially the same plane, which allows bottom surfaces of the lugs 120 to pass substantially unhindered adjacent or over the stationary plate 130 and rotatable plate 110 as the lugs 120 slide and swivel during operation.

A plurality of apertures 134 is formed in the stationary plate 130. The apertures 134 are used in combination with the lugs 120 to produce shearing or cutting forces to reduce the food waste. In the present embodiment of the disclosed stationary plate 130, the apertures 134 include a plurality of holes formed within the interior area of the stationary plate 130. In addition, the apertures 134 include a plurality of gaps 136 formed by a plurality of horizontal teeth along the edge of the central opening 132 where the rotatable plate 110 is positioned.

The stationary ring 140 is disposed about the periphery of the stationary plate 130. The stationary ring 140 has an inner wall 142, an upper shoulder 146, and a bottom shoulder 148. The inner wall 142 is substantially vertical with respect to the horizontal plane of the rotatable plate 110 and stationary plate 130. The upper shoulder 146 mounts adjacent the first housing portion 20, and the bottom shoulder 148 mounts adjacent the outside edge 138 of the stationary plate 130. The outside edge 138 of the stationary plate 130 mounts adjacent a shoulder 33 of the second housing portion 30 so that the stationary ring 140 and plate 130 are sandwiched between the housings 20 and 30 when the disposer 10 is manufactured. As noted above, additional techniques known in the art can be used to fixedly mount the stationary ring 140 in the housing of the disposer.

In the present embodiment of the reduction mechanism 100, the stationary ring 140 is preferably composed of Ni-Hard. Preferably, portions of the inner wall 142 are substantially perpendicular to the stationary plate 130, but this is not strictly necessary. In addition, the inner wall 142 of the ring 140 defines lower teeth 143, a ridge 144, and breakers or diverters 145. The lower teeth 143 are positioned adjacent the stationary plate 130 and the location where the weighted ends 126 of the lugs 120 pass when the disposer is operated. The ridge 144 projects a short distance inward toward the center of the ring 140. Ends of the lugs 120 are capable of passing under the ridge 144 when the disposer is operated. The lower teeth 143 in the present embodiment are inwardly projecting splines but could have other shapes. The lower teeth 143 are used as a grinding surface for food waste impacted and moved thereon as the lugs 120 and rotatable plate 110 are rotated during operation. The breakers or diverters 145 are also inwardly projecting splines. Other techniques and methods can be used for the construction of the stationary ring 140. For example, details of stationary rings such as those disclosed in the incorporated U.S. Pat. Nos. 6,007,006 and 6,439,487 can be used with the disclosed reduction mechanism 100.

The disclosed reduction mechanism 100 addresses the problem of sufficiently reducing fibrous or stringy food waste. As the plate 110 is rotated, the mere impact of the lugs 120 on food waste can reduce friable materials. The weighted ends 126 of the lugs 120 pass by the inner wall 142 of the ring 140 and create grinding forces on the food waste, which can also reduce such friable materials. Furthermore, the lugs 120 pass over the stationary plate 130 as the rotatable plate 110 is rotated. The passing of the lugs 120 over the apertures 134 in the stationary plate 130 creates shearing or cutting forces, which can reduce the size of fibrous or stringy materials. Therefore, the disclosed reduction mechanism 100 reduces food waste in two ways by both grinding and shearing to reduce the size of the food waste. More specifically, the combined action between the ends 126 of the lugs 120 and the inner wall 142 and teeth 143 of the ring 140 act as a grinding or shredding mechanism, while the combined action between the edges or side surfaces of the lugs 120 with the apertures 134 and gaps 136 act as a shearing or cutting mechanism.

As a grinding mechanism, friable food waste can be reduced to smaller particles by the mere impacts with the rotatable plate 10, lugs 120, and inner wall 142. The food waste is also reduced to smaller particles by the grinding forces or frictional interaction between the ends 126 of the lugs 120 and the inner wall 142 with teeth 143 of the ring 140. As a shearing mechanism, the food waste is reduced to smaller particles by the shearing or cutting forces produced by the interaction between the lugs 120 and a substantial number of the apertures 134 in the stationary plate 130. Such shearing or cutting forces can be beneficial in sufficiently reducing fibrous or stringy food waste.

As noted earlier, the lugs 120 of the disclosed reduction mechanism 100 have bottom surfaces or edges capable of passing over the stationary plate 130 in close proximity thereto in what is referred to as a shearing operation as the rotatable plate 110 rotates. Shearing thus refers to the ability of the bottom surfaces, edges, or blades of the lugs 120 to have contact with or near contact with the surfaces of the stationary plate 130 to allow the food to be sheared (i.e., cut) therebetween. In this regard, the lugs 120 would not shear if they passed over the stationary plate 130 at a significant separation distance. As one skilled in the art will recognize, the separation distance permitting shearing action can depend on the size of the apertures 134, the resilience of the food waste, the mass of the lugs 120, and/or the speed of rotation of the plate 110, etc. A separation distance for shearing fibrous or stringy food waste would generally would be in the range of 0-2 mm. Furthermore, it is preferred that the bottom surfaces, edges or blades of the lugs 120 pass over the entire area of the apertures 134 so that food waste passing through the apertures 134 cannot avoid being sheared at the apertures 134 by the lug 120.

Some of the lugs typically used in disposers are formed from bent pieces of sheet metal and, therefore, usually have rounded edges. Preferably, the lugs 120 used in the disclosed reduction mechanism 100 are forged, cast, or machined and have substantially sharp edges formed with substantially flat bottom surfaces. During operation, the lugs 120 are capable or swiveling and sliding relative to the rotatable plate 110 and pass or travel over most if not all the apertures 134 in the stationary plate 130. The substantially sharp edges can enhance the shearing or cutting action that the lugs 120 produce when passing over the apertures 134 and gaps 136 in the stationary plate 110. The sharp edges can be formed by the bottom surface and a substantially perpendicular or acute sidewall. In addition, the lugs 120 are preferably forged or cast so that they can have an increased weight that is preferred for the disclosed reduction mechanism 100.

The apertures 134 in the stationary plate 130 control the size of discharged particulate matter during the reduction operation. Because a radial gap does not exist between the stationary ring 140 and the rotatable plate 110 as seen in the prior art disposers (although such a radial gap could be provided), all the particulate matter produced in the grinding section 14 is discharged through the apertures 134 in the stationary plate 130. The size, number, and arrangement of these apertures 134 can be adjusted to obtain a desired amount of fineness of the particulate matter and an acceptable time for the reduction operation. The apertures 134 can be substantially round but can otherwise have any desirable shape. In addition, apertures (not shown) can be provided in the rotatable plate 110.

Preferably, the apertures 134 have a cross dimension or diameter of approximately from 3/16-inch and are arranged in a substantially uniform fashion where the lugs 120 may pass. Preferably, the percentage of open area through the stationary plate 130 due to the size and number of apertures 134 is approximately 33 percent of the total surface area of the stationary plate 130. This percentage of open area has been found to be particularly suited for sufficiently reducing food waste, including fibrous and stringy waste, typically encountered by a food waste disposer. In general, however, consideration should be paid to a number of variables to achieve a suitable fineness of the particulate matter and an acceptable time for the reduction operation for a particular implementation of the reduction mechanism 100. Too much open area in the stationary plate 130, for example, can allow undesirably large particulate matter to pass therethrough without being adequately reduced. In addition, too much open area can allow too much water to pass therethrough, causing food waste to collect inside the food conveying section 12 without being flushed to the discharge. Too little open area can prolong the reduction operation and can cause water to "back-up" in the food conveying section 12, which is generally not desirable.

Figure 2A:
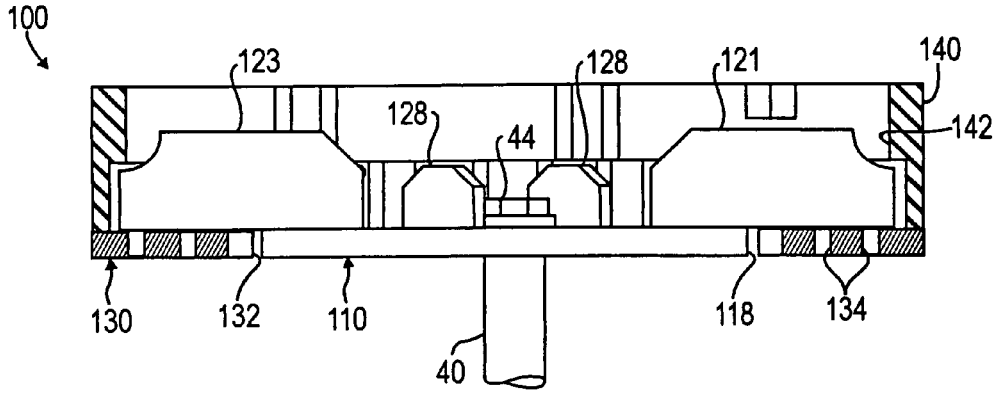
FIGS. 2A-2B illustrate various views of another embodiment of a reduction mechanism for shearing and grinding food waste according to certain teachings of the present disclosure, the disclosed reduction mechanism having a stationary ring, stationary plate, rotating plate, and fixed lugs.
Figure 2B:
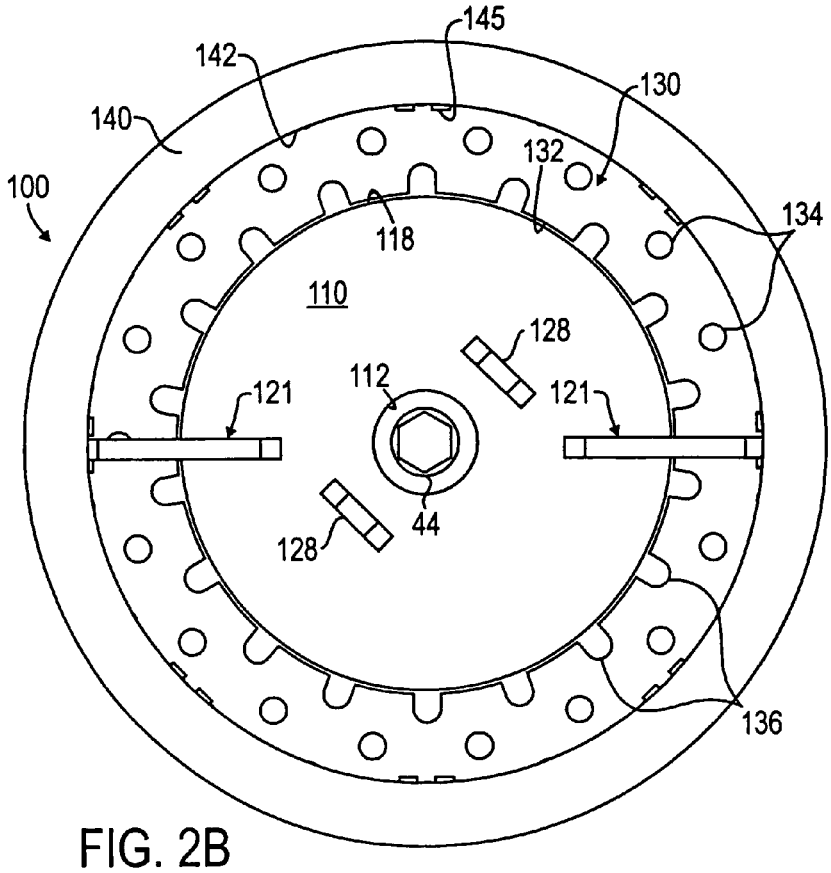

In alternative embodiments, the lugs 120 may be fixedly attached to the rotatable plate 110. For example, the rotating plate 110 in FIGS. 2A-2B has fixed lugs 121. FIG. 2A shows the reduction mechanism 100 in side cross-section, and FIG. 2B shows the reduction mechanism 100 in a top view. The fixed lugs 121 are attached to the peripheral portion of the plate 110 so that ends of the lugs 121 extend beyond the outside edge 118 of the plate 110. The ends of the fixed lugs 121 can, therefore, pass over the stationary plate 130 with apertures 134 to perform the shearing action of the disclosed reduction mechanism 100. The plate 110 may also include secondary lugs 128. Details related to preferred dimensions and placement of the fixed lugs 121 and secondary lugs 128 can be found in the incorporated U.S. Pat. No. 6,439,487.

Figure 3A:
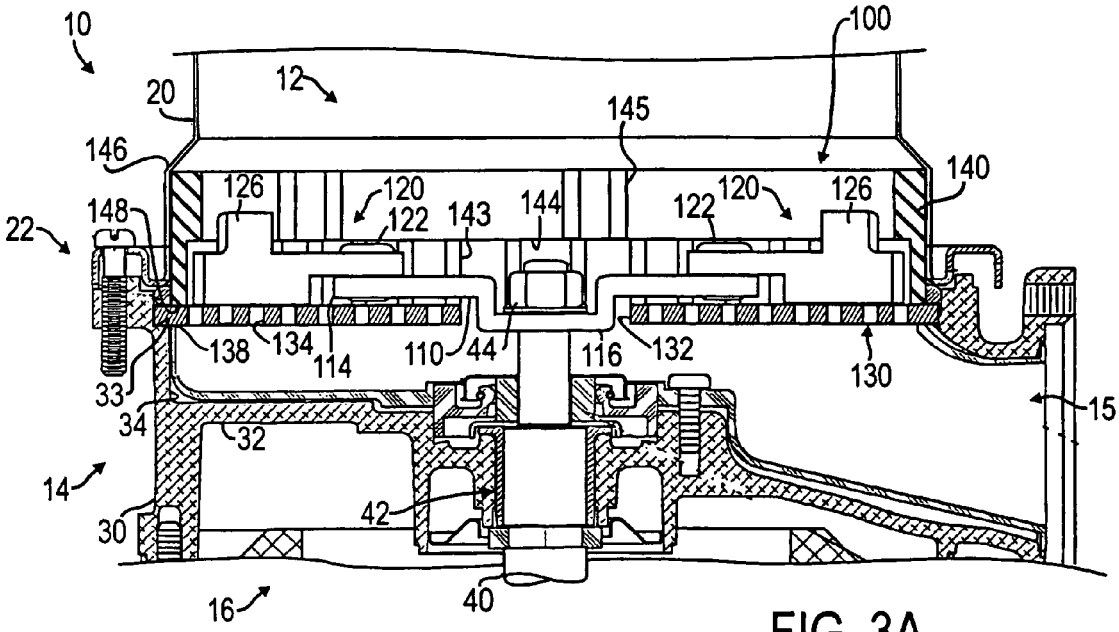
FIGS. 3A-3B illustrate various views of an embodiment of a reduction mechanism for shearing and grinding food waste according to certain teachings of the present disclosure, the disclosed reduction mechanism having a stationary ring, stationary plate, a rotating impeller, and movable lugs.
Figure 3B:
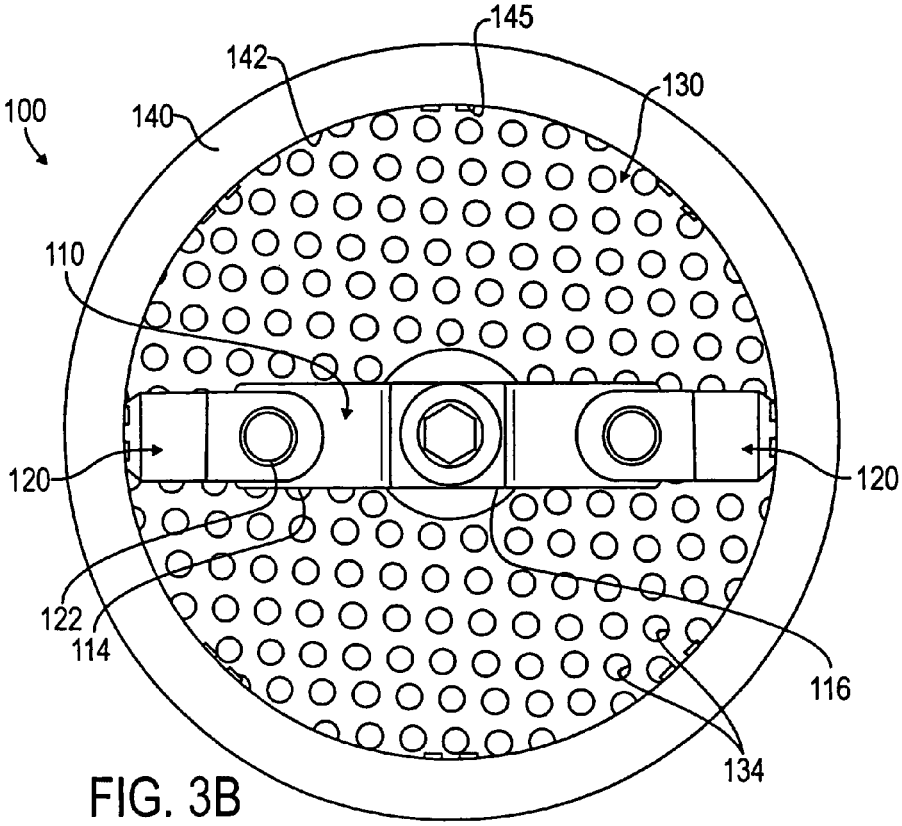

Referring to FIGS. 3A-3B, another embodiment of a reduction mechanism 100 according to certain teachings of the present disclosure is illustrated. In FIG. 3A, a portion of a food waste disposer 10 is illustrated in cross section having the disclosed reduction mechanism 100. In FIG. 3B, the disclosed reduction mechanism 100 is shown in a top view. The disclosed reduction mechanism 100 is positioned in the grinding section 14 and includes a rotatable member or impeller 110, one or more impact members or lugs 120, a first stationary member or plate 130, and a second stationary member or ring 140.

The rotatable impeller 110 is connected to the shaft 40 of the motor. The one or more lugs 120 are attached to the rotatable impeller 110. The stationary plate 130 is disposed adjacent the rotatable impeller 110, and the stationary ring 140 is disposed about the periphery of the stationary plate 130. The rotatable impeller 110 has a central portion 116 and one or more wing portions 114. The central portion 116 is mounted to the shaft 40 by a mounting fastener 44 known in the art. Preferably, the rotatable impeller 110 includes two wing portions 114 as shown, and one lug 120 is preferably attached to each wing portion 114.

In the present embodiment, the lugs 120 are movably attached to the wing portions 114. Fastening posts 122 have one end attached in holes (not visible) in the wing portions 114 and have other ends attached in throughholes (not visible) in the lugs 120 that allow the lugs 120 to swivel relative to the rotatable impeller 110. The lugs 120 have bottom surfaces adjacent the stationary plate 130 and have weighted ends 126 on an opposite end of the lugs 120 from the posts 122. The lugs 120 preferably have sharp edges formed with the substantially flat bottom surfaces. For example, the edges can be formed by the bottom edge and a substantially acute or perpendicular sidewall as shown and as discussed earlier. In alternative embodiments, the lugs 120 may be fixedly attached to the wing portions 114.

Certain details of the stationary plate 130 and ring 140 are substantially similar to those described above. The stationary plate 130 defines a central opening 132 in which the central portion 116 of the rotatable impeller 110 is positioned. The stationary plate 130 defines a plurality of apertures 134 therethrough that are distributed from the inner wall 142 of the ring 140 to the central opening 132 of the plate 130. As noted above, the apertures 134 in the stationary plate 130 control the size of discharged particulate matter, and the size, number, and arrangement of these apertures 134 can be adjusted to obtain a desired amount of fineness of the particulate matter and an acceptable time for the reduction operation. The apertures 134 can be substantially round but can otherwise have any desirable shape. Preferably, the apertures 134 have a cross dimension or diameter of approximately 3/16-inch and are arranged in a substantially uniform fashion. Preferably, the percentage of open area through the stationary plate 130 due to the size and number of apertures 134 is approximately 33 percent of the total surface area of the stationary plate 130.

The impeller 110 can be formed from a stock of sheet metal having a suitable thickness and can be bent into the wing shape as shown in FIGS. 3A-3B. As best shown in FIG. 3B, the U-shaped central portion 116 for attaching the impeller 110 to the motor shaft 40 with the fastener 44 may require a larger central opening 132 in the stationary plate 130 than desired. Accordingly, a sealing mechanism can be used at this juncture. For example, a cap member (not shown) can attach to the impeller's central portion 116 and substantially cover the central opening 132 in the stationary plate 130.

Figure 4A:
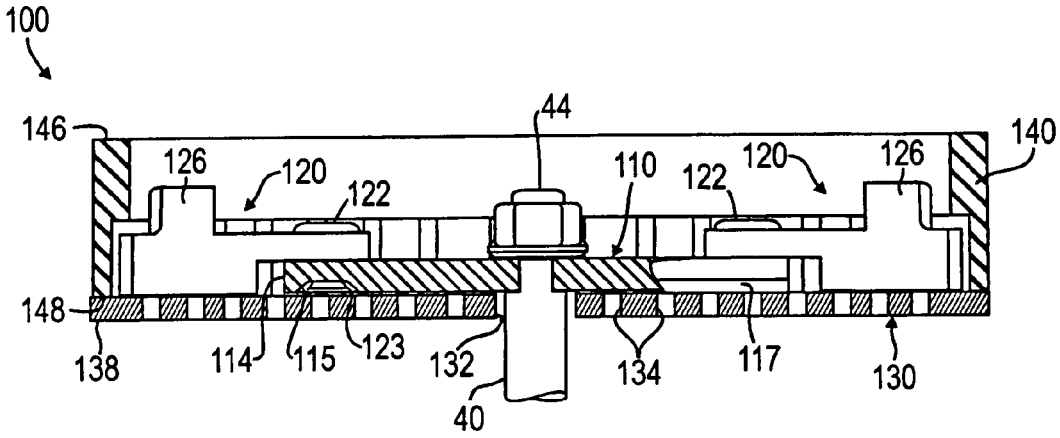
FIGS. 4A-4B illustrate various views of another embodiment of a reduction mechanism for shearing and grinding food waste according to certain teachings of the present disclosure, the disclosed reduction mechanism having a stationary ring, stationary plate, a rotating impeller, and movable lugs.
Figure 4B:
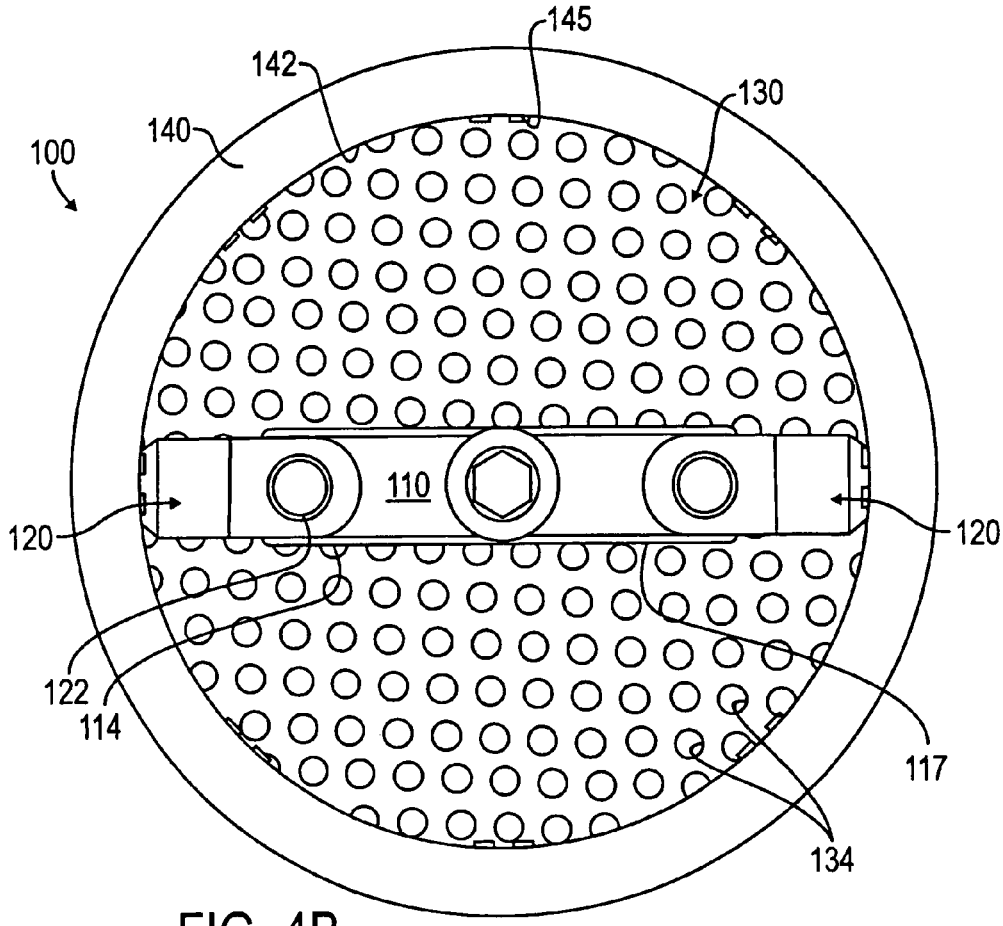

An alternative embodiment of the reduction mechanism 100 is illustrated in the side cross-sectional view and the top view of FIGS. 4A-4B, respectively. The embodiment of the reduction mechanism 100 in FIG. 4A-4B is substantially similar to that disclosed with reference to FIGS. 3A-3B. However, the impeller 110 can be a substantially flat bar of material as shown in FIGS. 4A-4B. A flat, central portion of the impeller 110 can attach to the shaft 40 so that the central opening 132 in the stationary plate 130 does not need to be much larger than the dimension of the shaft 40.

In either of the embodiments disclosed in FIGS. 3A-3B or 4A-4B, the wing portions 114 and not just the lugs 120 can also produce shearing or cutting forces by passing over the apertures 134 in the plate 130 to reduce the food waste. Accordingly, the bottom of the impeller 110 can define a recess 115 (shown in FIG. 4A, for example) for hiding the end 123 of the pin 122 that holds the lug 120 to the wing portion 114. In this way, the wing portion 114 can be positioned substantially close to the plate 130 for producing the shearing forces. Furthermore, to enhance the shearing action, the wing portions 114 can have acute (i.e., bladed) or perpendicular edges or sides 117 to pass substantially adjacent the surface of the plate 130 and create cutting action with the apertures 134. In one embodiment, the impeller 110 may be forged, cast, or machined to have a preferred thickness, weight, and/or cutting edges 117.

Figure 5A:
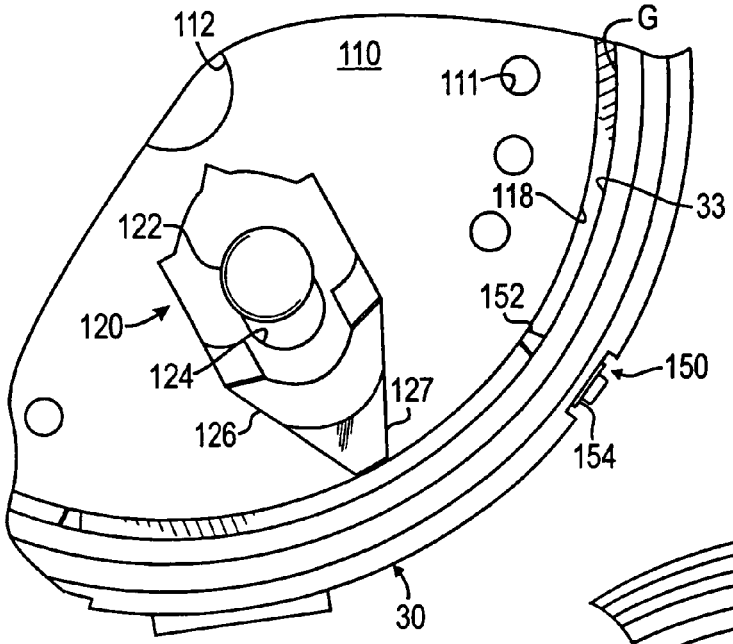
FIGS. 5A-5C illustrate various views of an embodiment of a reduction mechanism for shearing and grinding food waste according to certain teachings of the present disclosure, the disclosed reduction mechanism having stationary cutting elements mounted on the disposer.
Figure 5B:
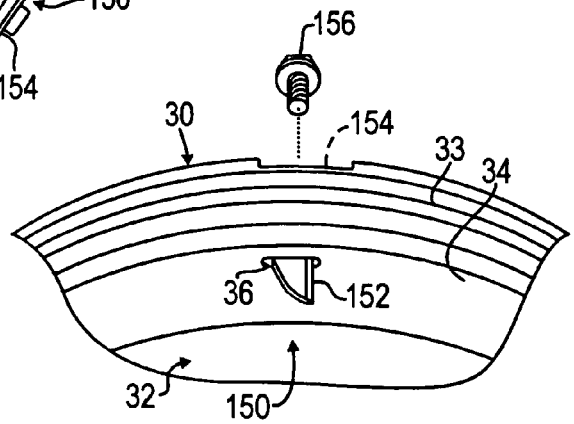
Figure 5C:
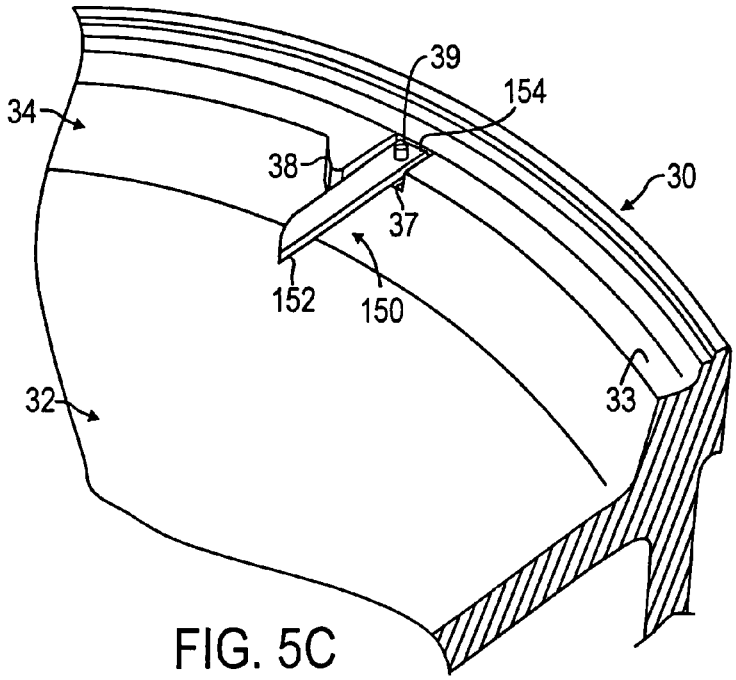

Referring to FIGS. 5A-5C, portions of another embodiment of a food waste reduction mechanism are illustrated in various views. For clarity, not all of the components of the reduction mechanism and disposer are shown or discussed, particularly those that have been discussed earlier or that are well known in the art. In FIG. 5A, the disposer is only partially shown having the upper housing removed. In the top view of FIG. 5A, a rotatable plate 100 is shown positioned within an upper end bell 30 of the disposer's housing. The reduction mechanism includes a rotatable plate 110, impact members or lugs 120, and a stationary ring (not shown). As shown in FIG. 5A, the lugs 120 can include a toe 127 on the weighted end 126 that extends to the outside edge 118 of the plate 110. As disclosed above, the stationary ring (not shown) positions against the rim 33 of the upper end bell 30, and the lugs 120 on the rotatable plate 110 are moved relative to the inside surface of the stationary ring (not shown) to shear and grind the food waste. The reduced food waste then falls through the gap G formed between the outside edge 118 of the plate 110 and the inner wall of the upper end bell 30. Because the stationary ring is not shown in FIG. 5A, the gap G around the outside edge 118 of the plate 110 is shown larger than may actually be used in a particular implementation.

The reduction mechanism of the present embodiment also includes a plurality of stationary cutting elements 150 used in conjunction with the rotatable plate 110, lugs 120, and stationary ring (not shown). The stationary cutting elements 150 are disposed about the upper end bell 30 of the disposer for shearing or cutting any fibrous or stringy materials that are discharged in the outer gap G between the stationary ring (not shown) and the edge 118 of the rotatable plate 110.

In the perspective views of FIGS. 5B-5C, the disposer is again only partially shown, and the rotatable plate 110 is shown removed to reveal portions of the upper end bell 30 and cutting elements 150. The stationary cutting elements 150 include a sharp end or blade 152 and a mounting end 154. The stationary cutting elements 150 are mounted in a sidewall 34 of the upper end bell 30 so that the blades 152 project substantially horizontally below the bottom surface of the rotatable plate (not shown). A number of techniques known in the art can be used to mount the elements 150 to the upper end bell 30. For example, the blades 152 can be disposed in slots 36 in the sidewall 34, and a fastener mechanism (not shown) can be used to fasten the mounting end 154 to the outside wall of the upper end bell 30. A conventional sealant (not shown) can be used to seal the slot 36 to prevent leakage. In a modification shown in FIG. 5C, the cutting elements 150 are preferably positioned in a recess 37 formed within the sidewall 34 of the upper end bell 30. The upper end bell 30 is typically cast or molded and can be metal or plastic. Consequently, the recess 37 for the cutting element can be cast, molded, or machined into the upper end bell 30. A shoulder 38 can be provided to stabilize the cutting element 150, and a pin or other retainer 39 can hold the attachment end 154 of the cutting element 150 in the recess 37. Thus, any potential for leakage in the sidewall 34 of the upper end upper end bell 30 of the disposer can be avoided.

During operation of the disposer, the rotatable plate 110, lugs 120, and stationary ring (not shown) reduce the food waste in a conventional manner. The reduced food waste is then allowed to pass through the gap G formed between the outside edge 118 of the plate 110 and the inner wall of the stationary ring (not shown). As noted above, fibrous or stringy food waste may be able to fit between the gap G of the rotatable plate 110 and the stationary ring (not shown) without being sufficiently reduced to a desirable size. The plurality of cutting elements 150 mounted in the upper end bell 30 can cut any fibrous or stringy material that is discharged through the gap G. During the reduction operation, the food waste is being impacted, moved, and rotated so that any fibrous or stringy food waste fitting in the gap G will be cut or sheared by the stationary cutting elements 150. Specifically, as the plate 110 rotates, food waste moved by the plate 110 is tangentially flung at the stationary blades 152, thereby cutting the food waste. If beneficial, the toes 127 of the lugs 120 can be extended at least partially over the gap G, to improve the ability of the lugs 120 to impact food waste into the gap G and to assist in shearing the food waste.

Figure 6A:
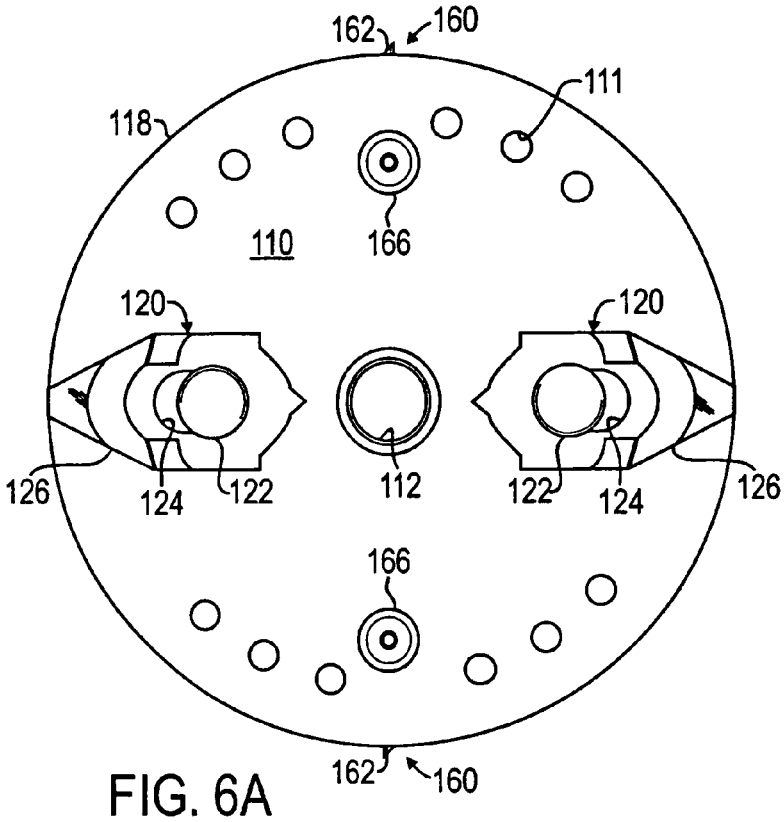
FIGS. 6A-6B illustrate various views of an embodiment of a reduction mechanism for shearing and grinding food waste according to certain teachings of the present disclosure, the disclosed reduction mechanism having cutting elements mounted on a rotatable plate.
Figure 6B:
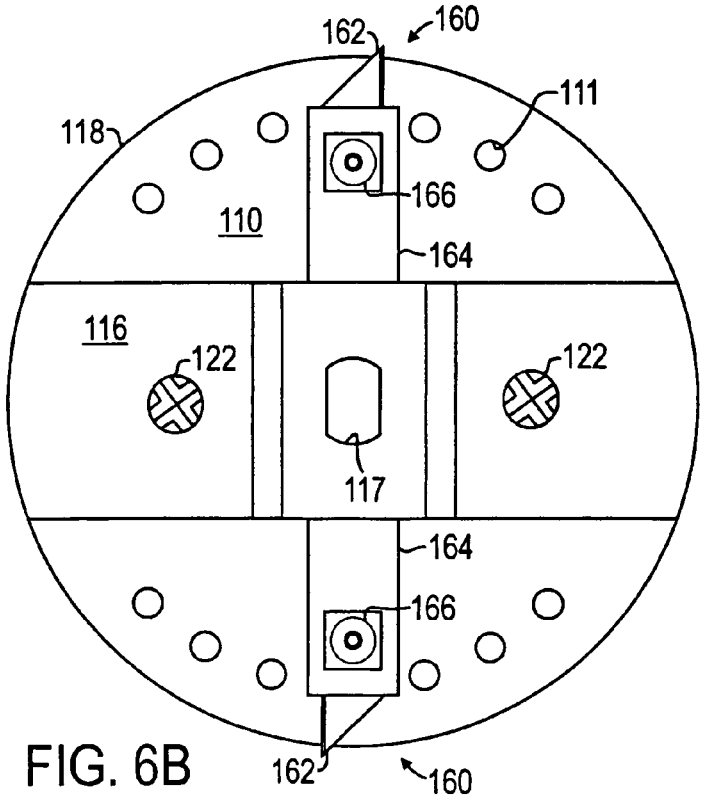

Referring to FIGS. 6A-6B, portions of another embodiment of a food waste reduction mechanism are shown in a number of isolated views, in which FIGS. 6A and 6B respectively show the top and bottom of the reduction mechanism. Again, not all of the components of the reduction mechanism and disposer are shown for the sake of clarity. The reduction mechanism includes a rotatable plate 110, impact members or lugs 120, and a stationary ring (not shown). The reduction mechanism also includes one or more cutting elements 160 mounted to the plate 110. Each cutting element 160 includes a blade 162, a housing 164, and a mounting mechanism 166. Preferably, the plate 110 has two or more such cutting elements 160 mounted on the bottom of the rotatable plate 110 to cut any fibrous material that is discharged through a gap between the stationary ring (not shown) and the outside edge of the rotatable plate as discussed earlier. The blades 162 and housings 164 are mounted to the bottom surface of the plate 110 using a mounting mechanism 166, such as a rivet. A number of other techniques known in the art can also be used to mount the housings 164 and blades 162 to the bottom of the rotatable plate 110.

As best shown in bottom view of the plate 110 in FIG. 6B, the housings 164 for each blade 162 can be separate components individually mounted to the plate 110. Alternatively, the housings 164 can be integral with one another so that a central portion passes between the rotatable plate 110 and a support member 116. The support member 116 is mounted to the bottom of the plate 1110 and mounts to the motor shaft (not shown). Teachings of such a support member 116 are disclosed in the incorporated U.S. Pat. Nos. 6,007,006 and 6,439,487 patents. The housings 164 provide structural support for the blades 162. Depending on the mounting mechanism 166 used to attach the blades 162 to the plate 110, however, such structural housings 164 may not even be required. In one embodiment, the blades 162 are free to rotate relative to the plate 110. During operation, centrifugal force keep the ends of the blades 162 beyond the edge 118 of the rotatable plate 110 for shearing or cutting any fibrous or stringy food waste escaping through the gap around the edge 118. Alternatively, the blades 162 can be fixedly mounted to the plate 110 so that the ends always extend beyond the edge 118 of the plate 110.

Figure 7A:
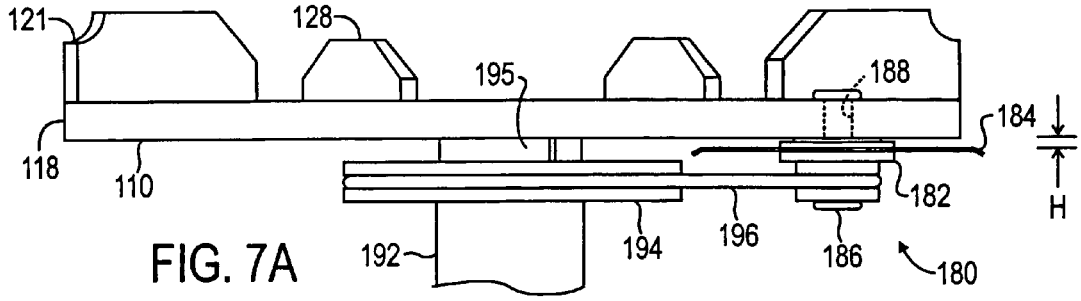
FIGS. 7A-7B illustrate various views of an embodiment of a reduction mechanism for shearing and grinding food waste according to certain teachings of the present disclosure, the disclosed reduction mechanism having cutting elements on a rotatable hub attached to a rotatable plate.
Figure 7B:
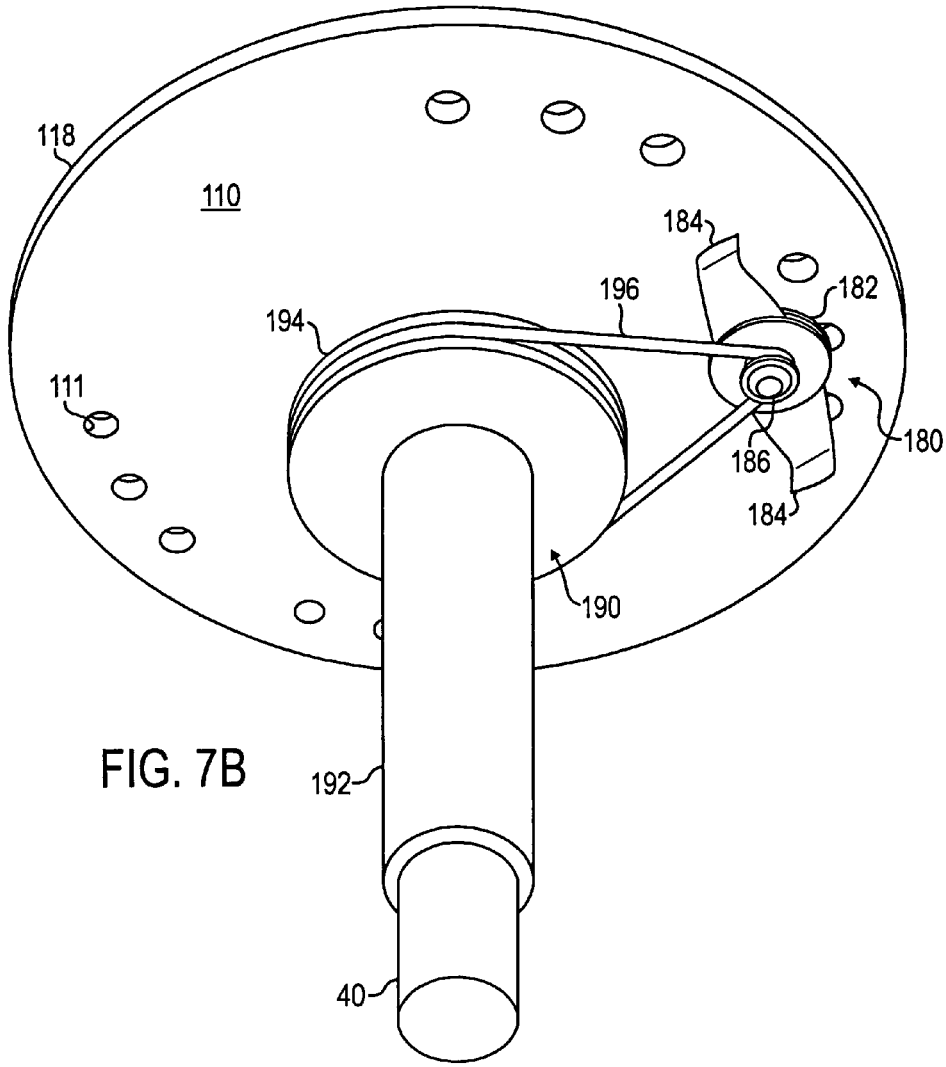

Referring to FIGS. 7A-7B, portions of another embodiment of a reduction mechanism are illustrated in relevant part in a number of isolated views, in which FIGS. 7A and 7B respectively illustrate a side view and a bottom perspective view. The reduction mechanism includes a rotatable plate 110, impact members or lugs 120, and a stationary ring (not shown). In the present embodiment, the impact members 120 are fixed to the rotatable plate 110 and include fixed lugs 121 and secondary lugs 128, having a design and location as disclosed in the incorporated U.S. Pat. No. 6,439,487 patent. The fixed lugs 121 and secondary lugs 128 are attached to the top surface of the plate 110, which is formed from a substantially thick piece of stock metal.

The reduction mechanism also includes one or more planetary under-cutting elements, only one of which is shown in FIGS. 7A-7B. The planetary under-cutting element includes a rotatable hub 180 mounted to the plate 110 by a pin or shaft 186. As best shown in FIG. 7B, the shaft 186 is mounted in a hole 188 in the plate 110 using a fastening mechanism known in the art. The planetary under-cutting element also includes one or more blades 184 disposed about the hub 180.

The reduction mechanism also includes a stationary hub 190 mounted about the motor shaft 40 and having an internal bore for the passage of the shaft 40. The stationary hub 190 can be a separate component affixed to the upper end bell (not shown) of the disposer adjacent the location of the bearing/sealing mechanism, such as described above. For example, a first portion 191 of the hub 190 may be an integral component of the upper end bell of the disposer, while a second portion 192 may be a separate component attaching to the first portion 191. Alternatively, the second portion 192 of the stationary hub 190 can be integrally formed on the first portion 191 attached to the upper end bell in this location of the disposer.

A drive member, such as a belt, chain, or the like, connects the stationary hub 190 to the rotating hub 180. In the present embodiment, a drive belt 196 is used. Thus, the second portion 192 of the stationary hub 190 and the rotating hub 180 preferably include peripheral tracks for the drive belt 196. In alternative arrangements, the hubs 180 and 190 can have interconnecting gears (not shown) using techniques known in the art. The drive belt 196 in the present embodiment is shown positioned between the blades 184 and the surface of the plate 110. Preferably, the drive belt 196 can connect to the hub 180 such that the blades 184 can be positioned between the drive belt 196 and the surface of the plate 110, which can allow the blades 184 to pass closer to the surface of the plate 110.

During operation, the stationary hub 190 does not rotate with the motor shaft 40. The rotatable hub 180 of the undercutter, however, is free to rotate. As the shredder plate 110 spins, the drive belt 192 connected between the hubs 180 and 190 causes the rotatable hub 180 to rotate in the opposite direction. The rotatable hub 180 can be made to rotate at a faster r.p.m. than the rotatable plate 110 because of the size ratio of peripheral tracks or ratio of gears, for example. To reduce food waste, the blades 184 pass over holes 111 in the plate 110 to cut food waste passing therethrough. In addition, ends of the one or more blades 184 on the rotatable hub 180 extend beyond the edge 118 of the rotatable plate 110. The ends of the blades 184 pass by the gap (not shown) formed between the edge 118 and stationary ring (not shown) to cut food waste passing through the gap.

The blades 184 pass a distance H from the bottom surface of the plate 110, as shown in FIG. 7B. Selection of the distance H may vary according to a particular implementation. To have a decreased distance H, it may be necessary for blades 184 to be positioned between the surface of the plate 110 and the location where the drive belt 192 connects to the hub 180.

Washers, bearings, or other like devices can be used to facilitate rotation of the hub 180 relative to the plate 110. For embodiments of the disclosed reduction mechanism having more than one rotatable hub 180, the distances H that the blades 184 pass relative to the plate 110 may be different for the individual hubs 180.

Figure 8:
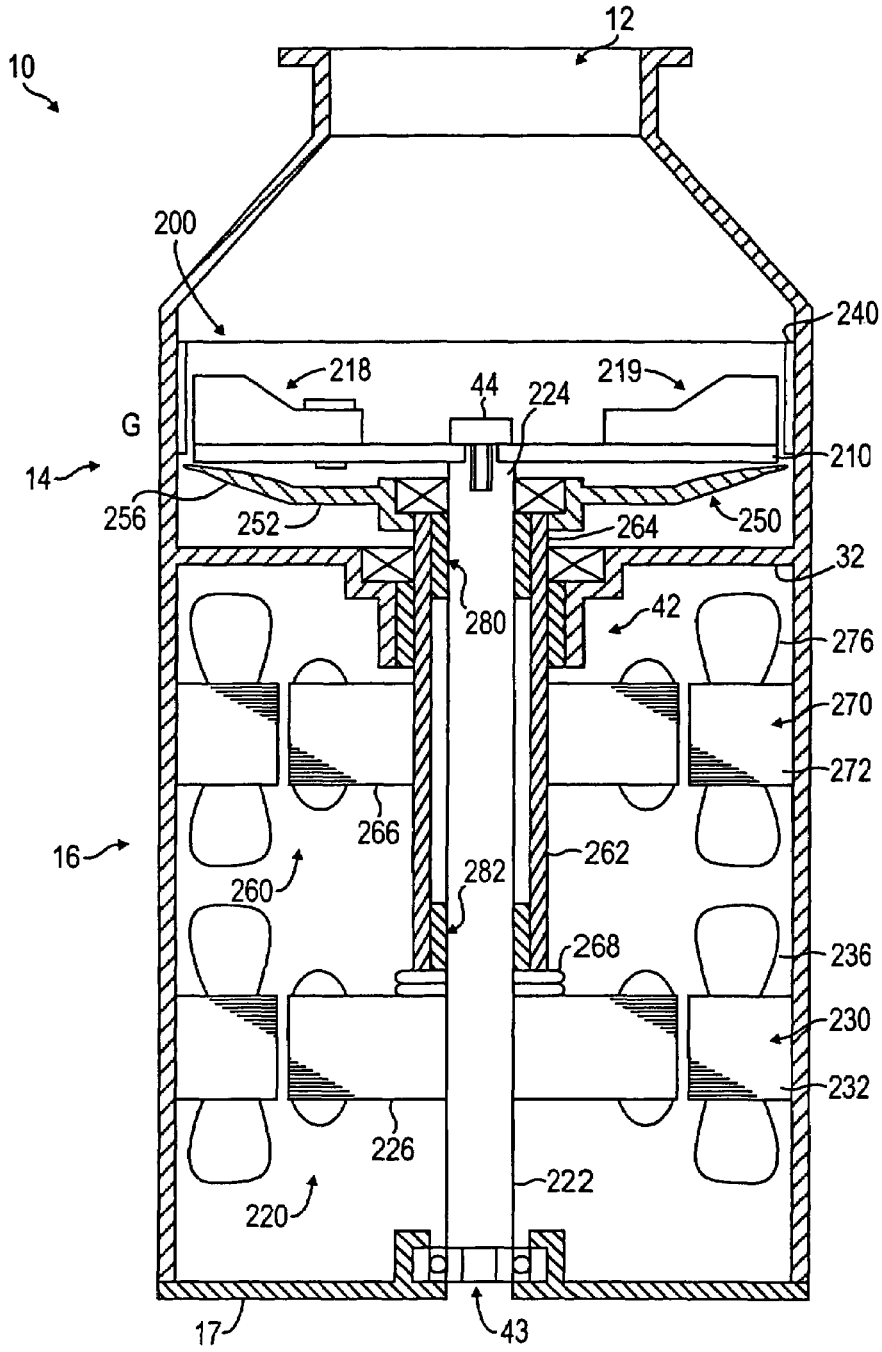
FIGS. 8, 9, 10A-10C, and 11 illustrate various views of an embodiment of a reduction mechanism for shearing and grinding food waste according to certain teachings of the present disclosure, the disclosed reduction mechanism having counter rotating elements.

Referring to FIGS. 8, 9, 10A-10C, and 11, portions of another embodiment of a reduction mechanism 200 for a food waste disposer 10 are illustrated in a number of views. In FIG. 8, the disposer 10 is schematically illustrated having the disclosed reduction mechanism. Again, not all of the components of the reduction mechanism 200 and disposer 10 are shown for clarity. By way of introduction and before discussion of the aspects of the Figures, the reduction mechanism 200 includes counter-rotating elements. As best shown in the disposer 10 schematically shown in FIG. 8, the first element 201 is a grinding mechanism having a rotatable plate 210 and a primary rotational source or motor 230 having a stator 232 and a rotor 220. The second element 205 is a cutting mechanism having a cutting member 250 and a secondary rotational source or motor 270 having a stator 272 and a rotor 260. The primary rotor 220 rotates opposite from the secondary rotor 260 so that the rotatable plate 210 rotates opposite from the cutting member 250. Accordingly, the stators 232 and 272 have windings 236 and 276 that are wired to have opposite polarity with each other, so each one of its corresponding rotors 220 and 260 turns in the opposite direction.

The primary motor 230 positions adjacent a lower end frame or bottom portion 17 of the motor housing 16. Preferably, the primary motor 230 comprises an induction motor known in the art, but the primary motor 230 can comprise other dynamo-electric machines known in the art, such as a universal motor or a permanent magnet motor. The motor 230 includes a primary stator 232 and a primary rotor 220. The primary stator 232 is mounted in the housing 16. The primary stator 232 includes a plurality of laminations defining a plurality of poles with windings 236 wound thereon. It is understood that a number of other motors designs can be used with the disclosed reduction mechanism.

Figure 9:
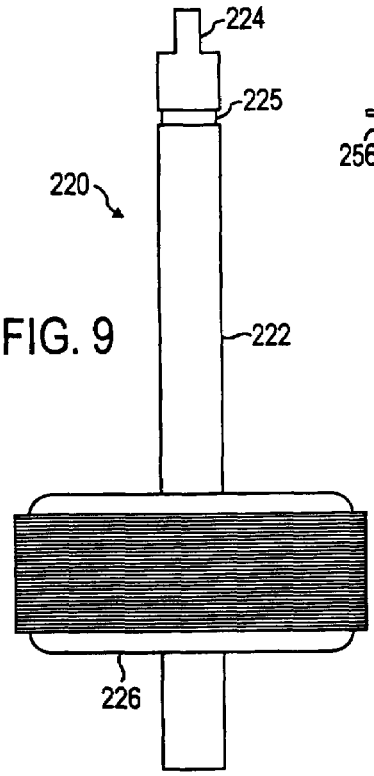

As best shown in FIG. 9, an embodiment of a primary rotor 220 has a shaft 222 and includes a plurality of laminations 226 mounted on the primary rotor shaft 222 using techniques known in the art. An attachment end 224 of the shaft 222 attaches to the rotatable plate (210) using techniques known in the art. The other end of the shaft 222 rests on a stabilizing bearing assembly (not shown) on the lower end frame 17 of the motor housing 16, such as is known in the art.

As best shown in FIG. 8, the secondary motor 270 positions adjacent the top of the motor housing 16. The secondary motor 270 can comprise an induction motor, a universal motor, a permanent magnet motor, or other dynamo-electric machine known in the art. The secondary stator 272 is mounted in the housing 16. The secondary stator 272 includes a plurality of laminations defining a plurality of poles 274 with windings 276 wound thereon. It is understood that a number of other motors designs can be used with the disclosed reduction mechanism.

Figure 10A:
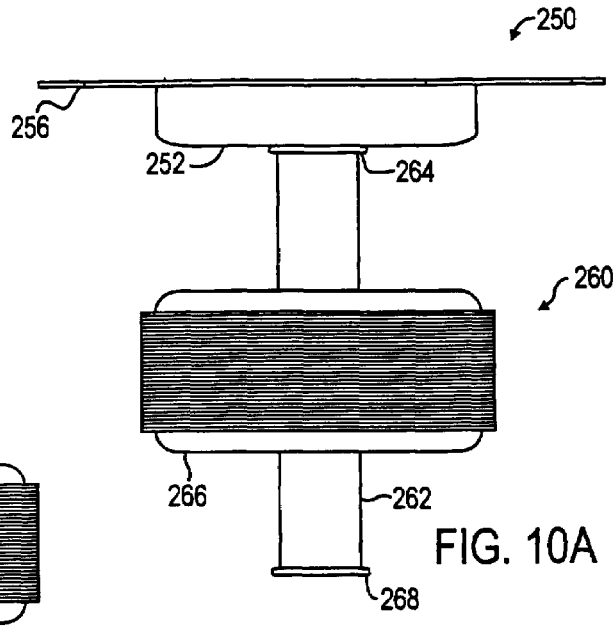
Figure 10B:
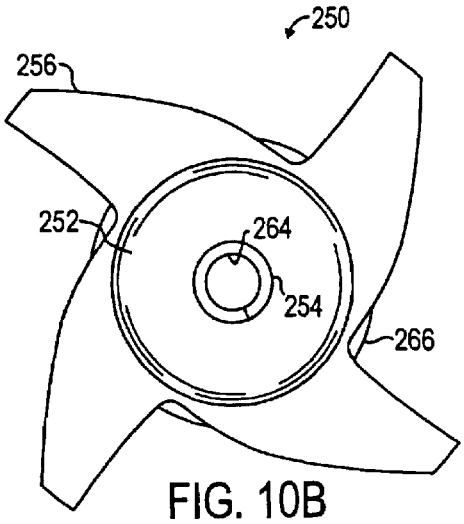
Figure 10C:
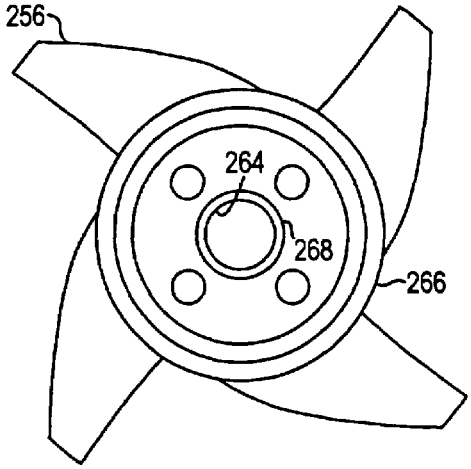
Figure 11:
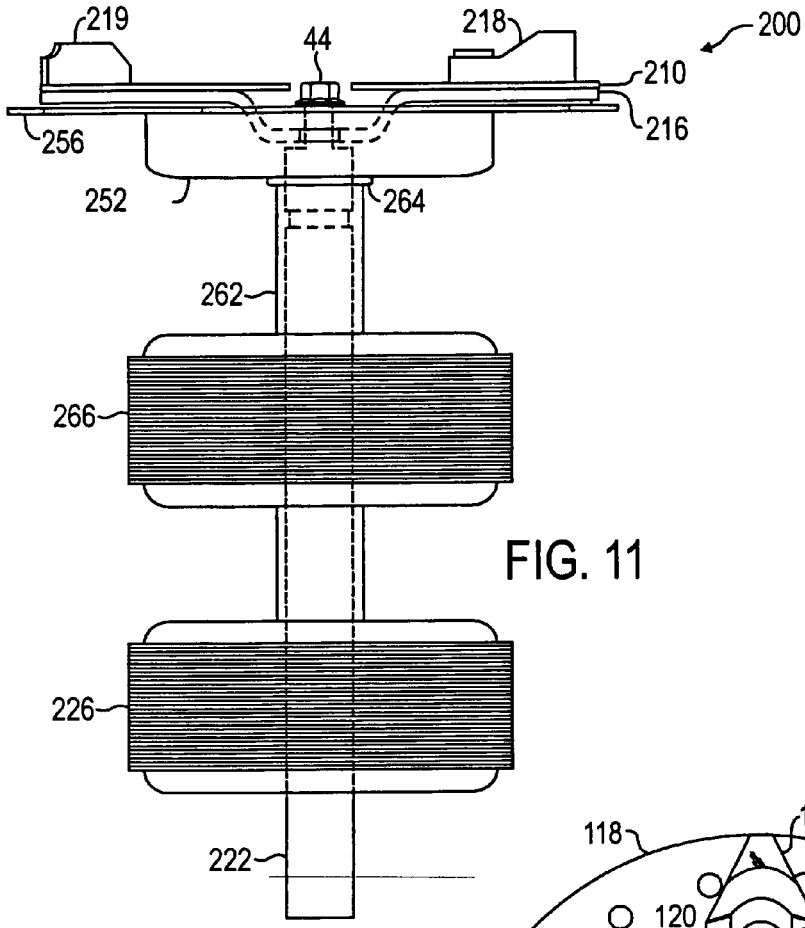

As best shown in FIGS. 10A-10C, an embodiment of a secondary rotor 260 includes a shaft 262 having a plurality of rotor laminations 266 mounted thereon using techniques known in the art. The shaft 262 defines a hollow cylinder for disposing about the primary shaft 222, as best shown in FIGS. 10B-10C. One end of the hollow shaft 262 is attached to the cutting member 250, which is positioned under the rotatable plate when the disposer 10 is assembled as shown in FIG. 11. When assembling the disposer 10, the hollow shaft 262 slides over the main rotor shaft 222 of the primary rotor 220.

As best shown in FIGS. 10A and 10B, the cutting member 250 includes central portion 252 with one or more cutting blades 256 disposed thereabout. The central portion 252 can be dish-shaped so as not to interfere with a support member of the rotatable member 110. A central opening 254 in the cutting member 250 attaches to an end 264 of the hollow shaft 262 using techniques known in the art so that the cutting member 250 is rotatable with the shaft 262. For example, a boss and flange can be used or the components can be welded together.

Referring to FIGS. 8 and 11, the rotatable plate 210 includes a support plate 216 attached to an end of the primary shaft by techniques common in the art. The rotatable plate 210 also includes swivel lugs 218 and fixed lugs 219, which are similar to those described earlier. The plate 210 and lugs 218 and 219 work in conjunction with a stationary ring 240 schematically shown in FIG. 8 to reduce food waste.

Any material that is discharged through the gap G between the stationary ring 240 and the rotatable plate 210 is reduced by the blades 256 of cutting member 250 rotating in the other direction. For example, the blades 256 cut or shear fibrous or stringy materials before they are discharged into the waste stream. Preferably, the secondary motor 270 is smaller than the primary motor 230 because most of the reduction work of the food waste has already been performed by the rotatable plate 210, lugs 218 and 219, and stationary ring 240. For example, the primary motor 230 can produce between ½ to 1-horsepower. In contrast, the secondary motor 270 can be approximately ⅓ to ⅕ the size of the primary motor 230. In one embodiment, therefore, the secondary motor 270 may produce about ⅛-horsepower. Accordingly, the secondary motor 270 can be and preferably is smaller than illustrated in the Figures.

In the schematic FIG. 8, a number of sealing and bearing mechanisms can be used for the rotors 220 and 260. A bearing/sealing mechanism 42 known in the art is preferably used where the hollow shaft 262 passes through the upper end bell or portion 32 of the motor housing 16. To stabilize the shaft 222, another bearing mechanism 43 known in the art is provided in the lower end frame or portion 17 of the disposer 10. The upper end of the shaft 262 can include an internal bearing and sealing mechanism 280. The lower end 268 of the shaft 262 can also include an internal bearing mechanism 282 disposed about the primary shaft 222 and/or disposed on the laminations 226 of the primary rotor 220, for example. The internal bearing mechanisms 280 and 282 can be used to stabilize and improve rotation of the shafts 222 and 262 relative to one another.

Figure 12:
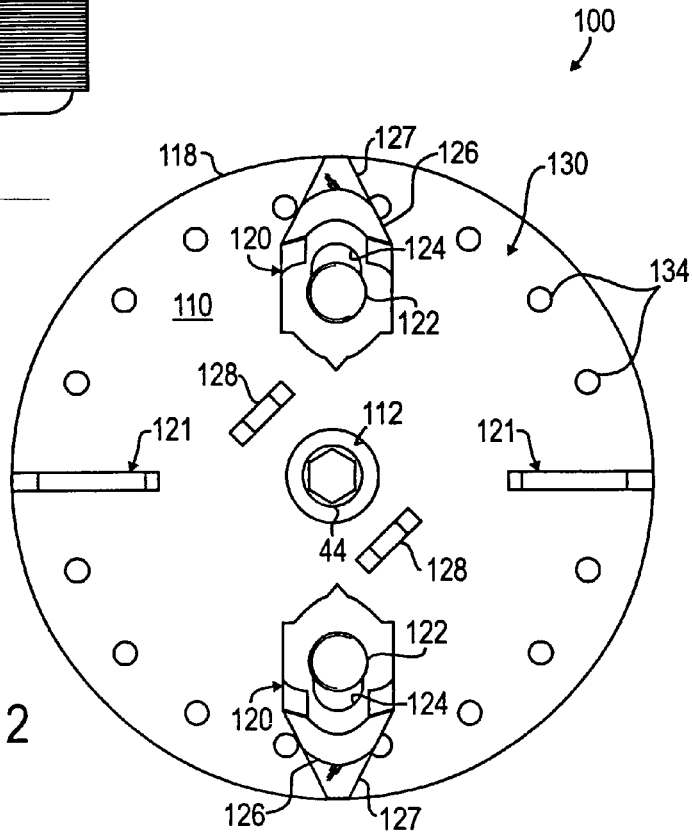
FIG. 12 illustrates a top view of an embodiment of a rotatable plate having both fixed and movable lugs.

Referring to FIG. 12, relevant parts of another embodiment of a reduction mechanism are illustrated in a top view. The disclosed reduction mechanism includes a rotatable plate 110 having both fixed and movable impact members 120. The impact members 120 on the plate 110 include movable lugs 320 and fixed lugs 330. The movable lugs 320 can include a toe 327 on a weighted end 326 that extends to an outside edge 118 of the plate 110. Elongated apertures 324 in the lugs 320 allow the lugs 320 to rotate and slide relative to a pin 322 attaching the lug 320 to the plate 110. The fixed lugs include primary lugs 330 positioned near the edge 118 of the plate 110. Secondary lugs 335 can be positioned within the interior of the plate 110. Teachings of preferred dimensions and locations of such fixed lugs 330 and 335 are disclosed in the incorporated U.S. Pat. No. 6,439,487 patents. Various embodiments of reduction mechanisms in the present disclosure can incorporate the present embodiment of the rotatable plate 110 of FIG. 12.

Figure 13:
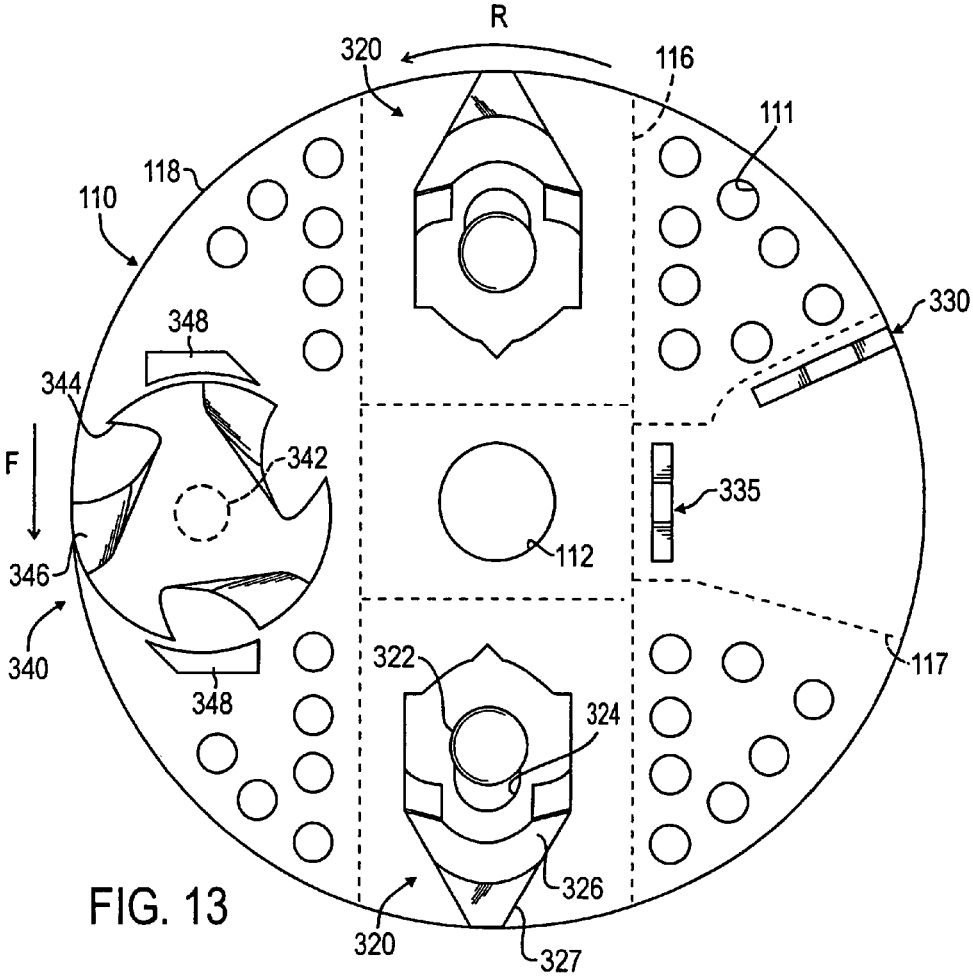
FIG. 13 illustrates a top view of an embodiment of a rotatable plate having fixed, movable, and rotatable impact members.

Referring to FIGS. 13 and 14A-14D, relevant parts of another embodiment of a reduction mechanism are illustrated in various views, in which FIG. 13 shows a top view of a rotatable plate 110 having various impact members and FIGS. 14A-14D shows side views of these impact members. As noted in the Background Section of the present disclosure, the actual size reduction or grinding of the food particles in typical food waste disposers is done by the interaction of the features on the rotating shredder plate with the stationary grind ring. Typically, swivel lugs are used in these grind mechanisms to throw the food against the stationary ring and reduce the size by breaking of the material with impact forces. While this approach is suitable for hard, friable materials, it can be an ineffective approach to grinding fibrous or elastic foods, such as cornhusks or chicken skin, that require shearing and/or tearing to reduce the size. In the present embodiment of the disclosed reduction mechanism, the rotatable plate 110 has a plurality of impact members, including movable lugs 320, fixed lugs 330 and 335, and a rotating lug 340. The movable lugs 320 can be of conventional design and can include a toe 327 on a weighted end 326 that extends to an outside edge 118 of the plate 110. The movable lugs 320 break down friable foods through impact against a stationary ring (not shown). Elongated apertures 324 in the lugs 320 allow the lugs 320 to rotate and slide relative to a pin 322 attaching the lug 320 to the plate 110. The fixed lugs include primary lugs 330 positioned near the edge 118 of the plate 110. Secondary lugs 335 can be positioned within the interior of the plate 110. Teachings of preferred dimensions and locations of such fixed lugs 330 and 335 are disclosed in the incorporated U.S. Pat. No. 6,439,487 patent. The fixed lugs 330 and 335 are effective at tearing elastic foods waste, such as poultry skin. In addition, the fixed lugs 330 and 335 are effective at preventing fibrous food waste from "balling up" and are effective at increasing the overall fineness of the particulate matter produced by the reduction mechanism. The rotating lug 340 is designed to grab or snag fibrous food waste and pull it across breakers 348 to shear the fibrous food waste into shorter lengths.

Figures 14A, 14B, 14C, 14D:
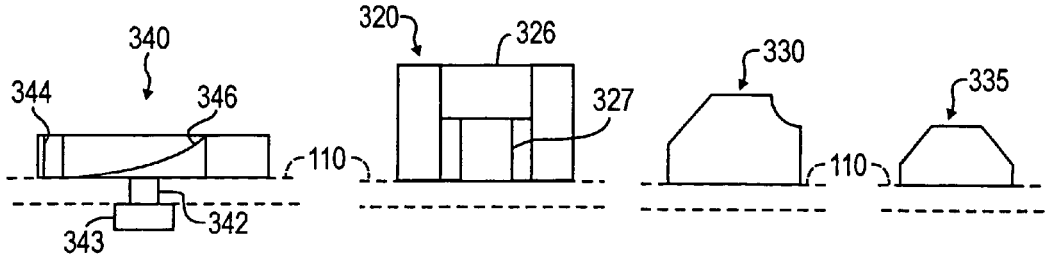
FIGS. 14A-14D illustrate side views of the impact members for the rotatable plate of FIG. 13.

As shown in FIGS. 14A-14D, each of these impact members 320, 330, 335, and 340 has a different height so that it interacts with a different portion of the stationary ring (not shown) that is positioned about the edge 118 of the rotatable plate 110. The height differential also helps to break up bouncing harmonics of the food waste, thus reducing the potential for food waste to ride on the plate 110. The movable lug 320 as shown in FIG. 14B is the tallest of the impact members and has a stepped face. The upper portion 327*a* of the face interacts with the upper breakers and diverters on the stationary ring. The lower portion or toe 327*b* interacts with the lower teeth of the stationary ring and does finish grinding of the food waste.

The fixed lugs 330 and 335 as shown in FIGS. 14C-14D are slightly shorter than the swivel lugs 320 and have a narrow face width. Because the primary lugs 330 adjacent edge 118 are fixed and cannot move away from the stationary ring, they hold material against the stationary ring, which results in an overall finer grind than the use of swivel lugs alone.

As shown in FIG. 14A, the rotating lug 340 is very close to the surface of the plate 110 so that it can grab and shear longer pieces of food waste that may accumulate at the base of the stationary ring near the edge 118 of the plate 110. The rotating lug 340 is balanced to rotate on a central shaft 342 that attaches to the plate 110 by a boss or retainer 343. As shown in FIG. 13, the rotating lug 340 has a plurality of hooked teeth 344 for grabbing food waste accumulated at the base of the stationary ring. In addition, the rotating lug 340 has a plurality of pitched fins 346, which can facilitate its rotation. Breakers 348 are attached to the plate 110 on either side of the rotating lug 340 and interact with the hooked teeth 344 to tear and shear food waste.

In one embodiment, the rotating lug 340 can be rotated by the mere flow of water. F that occurs as the rotatable plate 110 is rotated in direction R. In another embodiment, the boss 343 that is on the shaft 342 on the underside of the plate 110 can be coupled to a stationary hub on the disposer by a drive member, such as a belt, in a similar fashion to the embodiment of the disclosed reduction mechanism of FIGS. 7A-7B. With such an arrangement, the rotating lug 340 would rotate counter to the direction R of the plate 110 so that the configuration of the hooked teeth 344 would need to be oriented in the reverse. Because the rotating lug 340 is balanced to rotate on the plate 110, it can continuously rotate by virtue of the water flow or drive member. In other words, during operation of the disposer, the rotating lug 340 can freely rotate when not substantially interfered so that the rotating lug 340 can be said to continuously rotates even if it impacts food waste now and again. By comparison, the swivel lug 320 cannot be said to rotate continuously like the rotating lug 340. During operation, the swivel lug 320 does not continuously rotate as the rotating lug 340 because centrifugal forces cause the weighted end of the swivel lug 320 to orient toward the edge 118 of the plate 110.

The rotatable plate 110 having the various lugs 320, 330, 335, and 340 is not symmetrical about its central portion 112 and may, therefore, not be balanced for rotation. To balance and evenly distribute the mass of the plate 110 with lugs 320, 330, 335, and 340, it may be necessary to attach or form mass balancing members on the plate 110. As described earlier, the rotatable plate 110 can have a support plate 116 attached to the bottom surface. For example, the support plate 116 is used to attach the rotatable plate 110 to a motor shaft (not shown) and to reinforce the plate 110 where the posts 322 of the moveable lugs 320 attach. As shown in FIG. 13, a mass balancing member 117 is attached to the bottom of the plate 110 adjacent the support plate 116 and may be an extended or separate portion of the support plate 116. The mass-balancing member 117 is positioned opposite the location of the rotating lug 340 to balance and evenly distribute the mass of the plate 110 and lugs 320, 330, 335, and 340 for rotation.

As used herein, the term "plate" is not meant to necessarily refer to a unitary body, or a body that is flat. Furthermore, the term "ring" is not meant to strictly refer to a unitary body having a continuous annular shape, nor a body having constant inner and outer diameters; multiple components may be arranged in a ring shape, and accordingly may still together be considered to constitute a "ring."

The foregoing description of preferred and other embodiments is not intended to limit or restrict the scope or applicability of the inventive concepts contained herein that were conceived of by the Applicant. In exchange for disclosing the inventive concepts contained herein, the Applicant desires all patent rights afforded by the appended claims. Therefore, it is intended that the inventive concepts contained herein include all modifications and alterations to the full extent that they come within the scope of the following claims or the equivalents thereof.

What is claimed is:

1. A food waste disposer having a rotational source, comprising:

a rotatable member coupled to the rotational source, the rotatable member having an impact member attached thereto;

a stationary plate disposed adjacent the rotatable member and having a plurality of apertures extending therethough disposed beneath the impact member;

a stationary ring having an inner wall disposed about the rotatable member; and the impact member having a bottom surface or edge that during operation of the food waste disposer shears over at least some of the apertures in the stationary plate to shear the food waste and having an outer end that during operation of the food waste disposer passes adjacent the inner wall of the stationary ring to grind the food waste.

2. The food waste disposer of claim 1, wherein the sum of the open areas of the apertures in the stationary plate is approximately ⅓ of the total surface area of the stationary plate.

3. The food waste disposer of claim 1, wherein the rotatable member includes a rotatable plate having a central portion attached to the rotational source.

4. The food waste disposer of claim 3, wherein the rotatable plate and the stationary plate are situated in the same plane.

5. The food waste disposer of claim 3, wherein the stationary plate has a central opening in which the rotatable plate is disposed.

6. The food waste disposer of claim 5, wherein the stationary plate further includes a plurality of gaps along an edge of the central opening.

7. The food waste disposer of claim 3, wherein the impact member includes a lug fixedly or movably attached to the rotatable member.

8. The food waste disposer of claim 3, wherein the impact member shears over the apertures in the stationary plate by passing at a separation distance of about 0 to 2 millimeters above the apertures.

9. The food waste disposer of claim 1, wherein the rotatable member includes a wing portion to which the impact member is attached.

10. The food waste disposer of claim 1, wherein the inner wall of the stationary ring includes a plurality of teeth.

11. The food waste disposer of claim 1, wherein the impact member includes a lug fixedly attached to the rotatable member.

12. The food waste disposer of claim 11 including an inner fixed lug fixedly attached to the rotatable member so that it is disposed inwardly from an outer edge of the rotatable member.

13. The food waste disposer of claim 1, wherein the impact member includes a lug movably attached to the rotatable member.

14. The food waste disposer of claim 13 wherein the lug includes a throughole movably attached to the rotatable member by a fastening post, the elongated throughole in the lug allowing the lug to slide and swivel relative to the rotatable member during operation of the food waste disposer.

15. The food waste disposer of claim 1 wherein the impact member includes a movable lug movably attached to the rotatable member and a fixed lug fixedly attached to the rotatable member.

16. The food waste disposer of claim 15 wherein the movable lug includes a throughole movably attached to the rotatable member by a fastening post, the elongated throughole in the lug allowing the movable lug to slide and swivel relative to the rotatable member during operation of the food waste disposer.

17. The food waste disposer of claim 15 including an inner fixed lug fixedly attached to the rotatable member so that it is disposed inwardly from an outer edge of the rotatable member.

* * * * *

UNITED STATES PATENT AND TRADEMARK OFFICE

CERTIFICATE OF CORRECTION

PATENT NO. : 7,500,628 B2
APPLICATION NO. : 11/725239
DATED : March 10, 2009
INVENTOR(S) : Thomas R. Berger et al.

It is certified that error appears in the above-identified patent and that said Letters Patent is hereby corrected as shown below:

Column 7, line 49, after "waste", delete "would".

Column 7, line 61, delete "or" and insert --of-- therefor.

Column 11, line 2, delete the first occurrence of "upper end".

Column 11, line 53, delete "1110" and insert --110-- therefor.

Column 13, line 38, delete "motors" and insert --motor-- therefor.

Column 13, line 56, delete "motors" and insert --motor-- therefor.

Column 14, line 64, delete "patents" and insert --patent-- therefor.

Column 15, line 5, delete "shows" and insert --show-- therefor.

Column 16, line 20, delete "rotates" and insert --rotate-- therefor.

Signed and Sealed this

Thirteenth Day of October, 2009

David J. Kappos

David J. Kappos
*Director of the United States Patent and Trademark Office*